United States Patent [19]

Tamura et al.

[11] Patent Number: 4,694,282

[45] Date of Patent: Sep. 15, 1987

[54] SECURITY MONITORING SYSTEM

[75] Inventors: Hiroshi Tamura; Yutaka Nakaie, both of Yokohama, Japan

[73] Assignee: Kabushiki Kaisha Toshiba, Kawasaki, Japan

[21] Appl. No.: 786,694

[22] Filed: Oct. 11, 1985

[30] Foreign Application Priority Data

Jan. 31, 1985 [JP] Japan ..... 60-017414

[51] Int. Cl.[4] ..... G08B 1/08

[52] U.S. Cl. ..... 340/539; 340/514; 340/531

[58] Field of Search ..... 340/539, 514, 531; 455/9, 53, 134, 127, 115, 229

[56] References Cited

U.S. PATENT DOCUMENTS

| | | | |
|---|---|---|---|
| 3,833,895 | 9/1974 | Fecteay | 340/539 |
| 3,914,692 | 10/1975 | Setborn, Jr. | 340/539 |
| 4,101,872 | 7/1978 | Pappas | 340/539 |
| 4,257,038 | 3/1981 | Rounds et al. | 340/539 |
| 4,396,910 | 8/1983 | Enemark et al. | 340/539 |

*Primary Examiner*—Donnie L. Crosland

*Attorney, Agent, or Firm*—Schwartz, Jeffery, Schwaab, Mack, Blumenthal & Evans

[57] ABSTRACT

A security monitoring system includes a radio transmitter which transmits information by a radio signal and a processing apparatus which receives the information transmitted by the radio transmitter to give necessary processing depending upon the contents of the information. The radio transmitter has a testing signal transmission means for transmitting testing signals and a setting means for setting the transmission level in transmitting the testing signal to the lowest operating level to provide a simulated worst-case testing environment.

20 Claims, 17 Drawing Figures

SECURITY MONITORING SYSTEM

BACKGROUND OF THE INVENTION

1. Field of the Invention

The present invention relates to a security monitoring system which detects, for example, the occurrence of an intruder or a fire in a home or a building, indicates the occurrence of an emergency situation, or the like to accomplish crime prevention, diasaster prevention, emergency rescue handling, etc. by quickly taking necessary measures.

2. Description of the Prior Art

A security monitoring system includes a plurality of terminal units, installed, for example, at an entrance, window, etc. through which an intruder may enter, or installed at various spots where a fire may break out, in order to detect a suspicious intruder or an occurrence of a fire in a home, a building, or the like, and a processing apparatus which receives en bloc signals that are detected at these terminal units to display an alarm or take other necessary measures. The processing apparatus, too, is generally installed at a prescribed spot in a home, a building, or the like where the terminal units are installed for detection. When a terminal unit for detection detects an intruder, occurrence of a fire, or the like, the processing apparatus notifies the occupants, employees, or the superintendent of the home or the building, as well as informs the monitoring center of the security company, for example, via the telephone circuit as the need arises. The terminal unit is not only a terminal unit for detection which is installed at a prescribed place and is used for detecting an intruder, occurrence of a fire, or the like, as described above, but also, the terminal unit may be used for signaling a device which is carried by the operator such as the occupant or the superintendent of the home or the building for informing of the occurrence of an emergency situation, such as a sick or injured person, or for providing an indication at the home or the building where the system is installed that the occupant or the superintendent is at or away from the home or building.

Such a terminal unit for detection or terminal unit for notification (signaling) is linked, to simplify the wiring work for example, to the processing apparatus by radio through the use of a radio transmitter, and is constructed as a radio transmitter for detection or a radio transmitter for notification. Generally, for a radio transmitter there is a coverage area which is determined corresponding to the intensity of the transmitted radio waves, so that the processing apparatus that receives the radio waves transmitted from the radio transmitter has to be installed within the coverage area of the transmitter.

Therefore, in installing each of the radio transmitters and the processing apparatus for a security monitoring system, they are to be installed to have their mutual separation within the coverage area of the radio transmitter, and in addition, a test is arranged to be made as to whether the processing apparatus can receive the signals reliably under the installation conditions.

However, even when each of the radio transmitters and the processing apparatus are installed properly and the transmission and reception tests between them were given properly, the intensity of the transmitted radio waves from the radio transmitter is sometimes reduced, because of the variations in the characteristics of the radio transmitter under the various influences such as temperature in the surroundings, variations in the power supply voltage, and scattering in the characteristics of each of the constituent parts. Consequently, even when the radio transmitter and the processing apparatus are installed to be within the coverage area in the normal conditions, and it is confirmed at the time of installation through the transmission and reception tests that they were definitely operating, the transmitted power of the radio transmitter is reduced and fails sometimes to reach the processing apparatus under the least favorable conditions, since the tests at installation are not carried out by considering the state in which the transmitted intensity is reduced, in particular, to the worst condition. Because of this, there exists a problem that even with a security monitoring system which operated normally at the time of installation, the transmitted power from the radio transmitter fails to reach the processing apparatus if, in its state of use, it finds itself in the worst condition due to a drop in the voltage of the power supply or a change in the surrounding temperature, and is unable to detect an intruder or occurrence of a fire, for instance, without failure. Accordingly, it has not been possible to ensure the shortest life for the security monitoring system.

SUMMARY OF THE INVENTION

An object of the present invention is to provide a security monitoring system which can guarantee a sure operation within the predetermined duration of shortest life.

Another object of the present invention is to provide a security monitoring system which is capable of carrying out the transmission test for the radio transmitter by taking the worst conditions into account.

Another object of the present invention is to provide a security monitoring system which is capable of carrying out a reliable test on the radio transmitter by considering the reduction in the transmission level due to such causes as the variation in the power supply voltage, changes in the surrounding temperature, and the scatter in the constituent parts.

One of the features of the present invention is that in a security monitoring system that includes a radio transmitter which transmits information by radio signals and a processing equipment which carries out necessary processing in accordance with the contents of the information that is transmitted from the radio transmitter, the radio transmitter is equipped with a test signal transmitting means which transmits test signals and a setting means which sets the transmission level to the lowest operating level in transmitting the test signals.

These and other objects, features and advantages of the present invention will be more apparent from the following description of a preferred embodiment, taken in conjunction with the accompanying drawings.

DESCRIPTION OF THE PREFERRED EMBODIMENT

Figure 1:
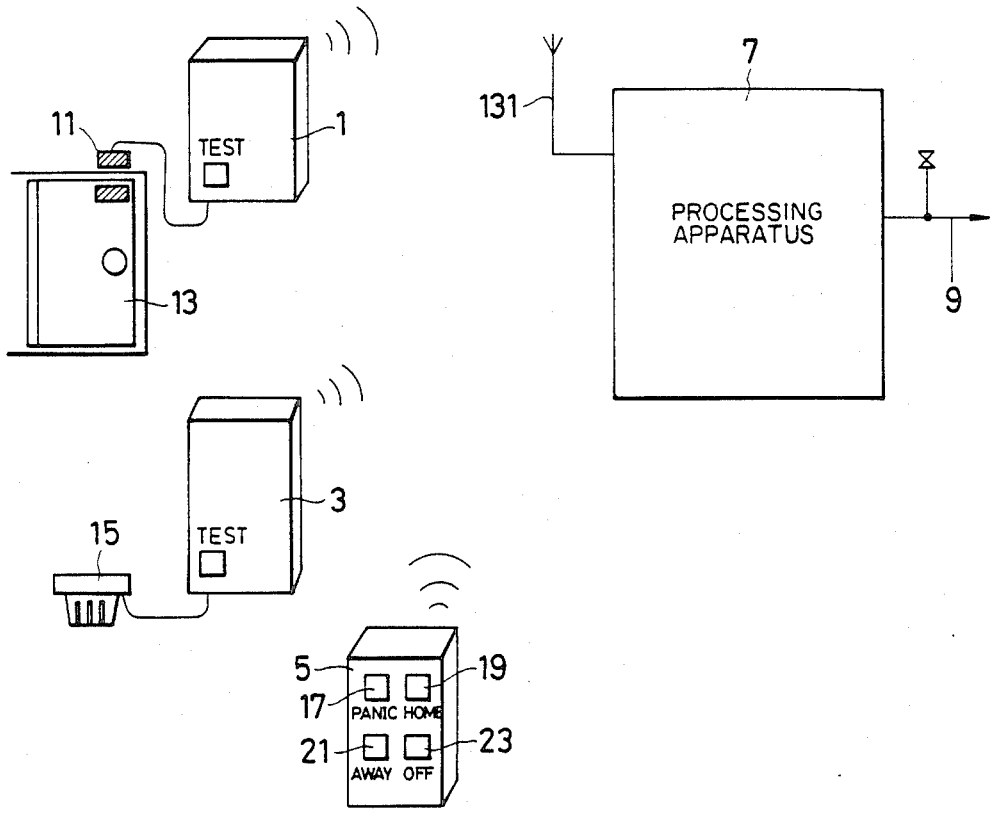
FIG. 1 is an overall block diagram for a security monitoring system embodying the present invention.

Referring to FIG. 1, there is shown an overall construction of a security monitoring system embodying the present invention which is installed, for example, in a home or a building. The security monitoring system includes as shown a plurality of radio transmitters 1, 3, and 5 and a processing apparatus 7 which receives signals transmitted by each of the radio transmitters by means of an antenna 131, and carries out generation and display of an alarm and other necessary processings depending upon the contents of the received signal. Further, the processing apparatus 7 is connected to the telephone circuit 9, and it is arranged, depending upon the contents of the signal received, to send out the information via the telephone circuit 9 to notify, for instance, the monitoring center of the security company.

The radio transmitter 1 is a radio transmitter for detecting the unauthorized intrusion of a suspicious intruder or the like, and it is connected to a detection switch 11 which detects the opening and closing of a door 13. The detection switch 11 will be in the on-state when the door 13 is opened by an intruder. The on-signal of the detection switch 11 is transmitted to the processing equipment 7 via the radio transmitter 1. Responding to the signal, the processing equipment 7 generates and displays an alarm to announce the presence of an intruder, as well as notifies the monitoring center via the telephone circuit 9.

The radio transmitter 3 is for detecting the occurrence of smoke or fire, and it is connected to a smoke detector 15 which is installed at a position within a home or a building where fires tend to break out. When smoke is detected, the smoke detector 15 supplies the smoke detection signal to the radio transmitter 3. The radio transmitter 3 transmits the smoke detection signal to the processing apparatus 7. Responding to the signal, the processing apparatus 7 generates and displays an alarm to announce the presence of smoke, as well as informs the monitoring center via the telephone circuit 9.

The radio transmitter 5 is for notification which, instead of being installed at a prescribed position as in the radio transmitters for detection 1 and 3, is portable and is carried by the operator such as an occupant or superintendent of a home or a building to inform the monitoring center of various emergency situations such as the occurrence of a sick or injured person, or to inform provide a notification of the presence or absence of the occupant or the superintendent in the home or the building where the system is installed. The radio transmitter for notification 5 includes a panic button 17 for informing of an emergency situation, a home button 19 for notification of the presence in the home or building of the occupant or the superintendent or the operator, an away button 21 for informing of the absence of people from the home or the building, and an off button 23 for releasing the emergency situation or the like. When the panic button 17, for instance, is operated, an emergency signal is transmitted from the radio transmitter for notification 5 to the processing apparatus 7, and an alarm is generated and displayed at the processing apparatus 7 and notification is sent to the monitoring center via the telephone circuit 9. In addition, when the home button 19, the away button 21, or the off button 23 is operated, the presence information, absence information, or off information is transmitted to the processing apparatus 7 from the radio transmitter for notification 5.

Figure 2:
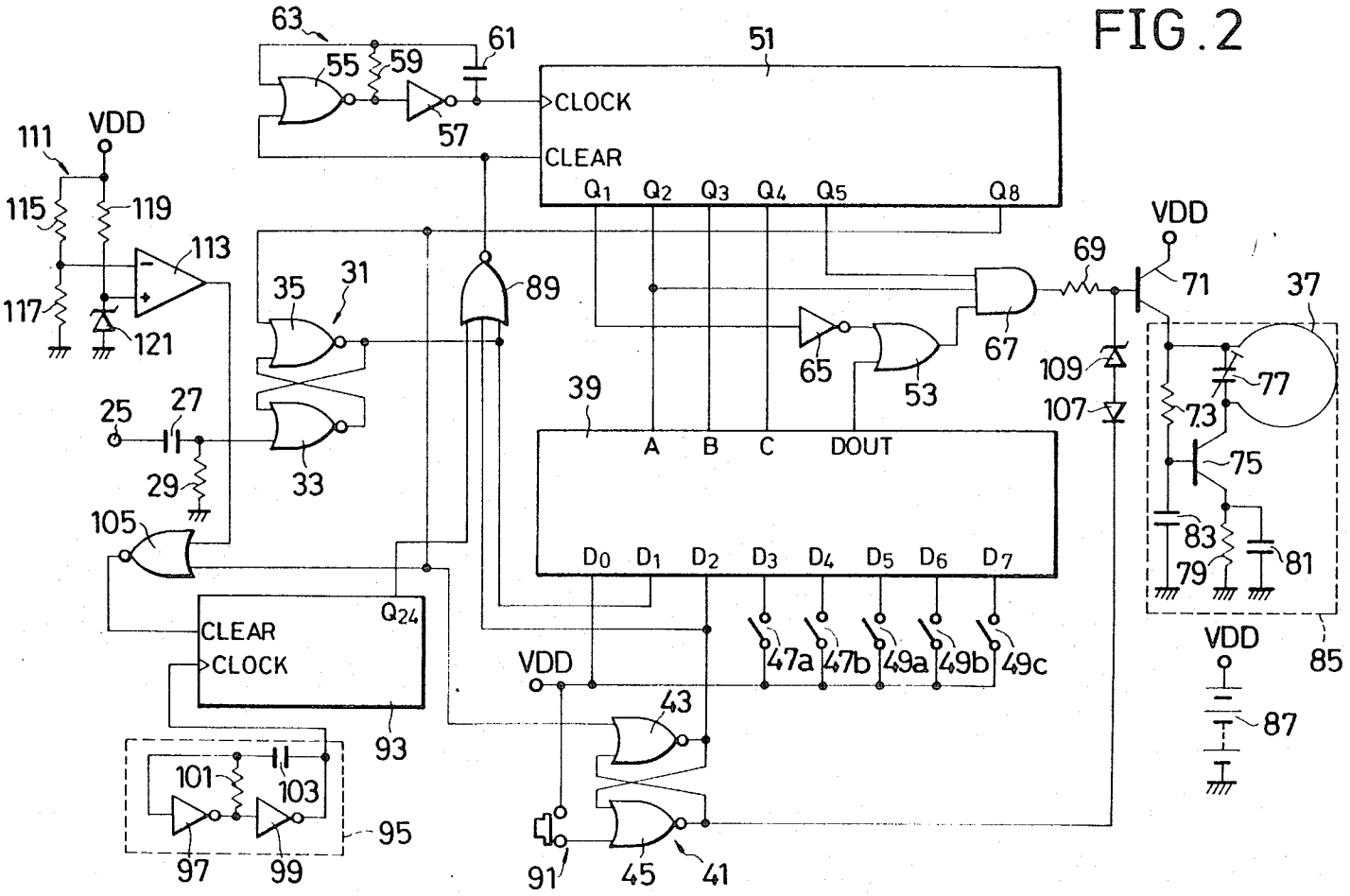
FIGS. 2 and 3 are the circuit diagrams for the radio transmitter for detection and the radio transmitter for notification, respectively, to be used for the security monitoring system shown in FIG. 1.

Referring to FIG. 2, there is shown a circuit diagram for the radio transmitter 1 or 3. A signal from the detection switch 11 for detecting the opening or closing of the door 13 or from the smoke detector 15 for detecting the occurrence of smoke is supplied to an input terminal 25, and is input as a set signal to one of the inputs of the NOR circuit that constitutes a flip-flop 31 via a differentiation circuit consisting of a capacitor 27 and a resistor 29. The output signal from the radio transmitter for detection is arranged to be transmitted to the processing apparatus 7 as a radio signal via an antenna 37. Further, the radio transmitter for detection is arranged to be operated by a power supply 87 with an output voltage Vdd.

The radio transmitter for detection shown in FIG. 2 possesses: (1) a detection operation mode which is actuated by the intrusion detection or the smoke detection signal supplied to the input terminal 25 by the detection switch 11 or the smoke detector 15, and transmits an alarm signal to the processing apparatus 7; (2) a test operation mode which transmits test signals to the processing apparatus 7 for testing the operation of the radio transmitter for detection; and (3) a check operation mode which transmits by means of an automatic operation which occurs at a fixed interval, to be more specific, at an interval of one hour, to the processing apparatus 7 operation checking signals that indicate the normal operation of own radio transmitter 1 or 3.

Figure 10A:
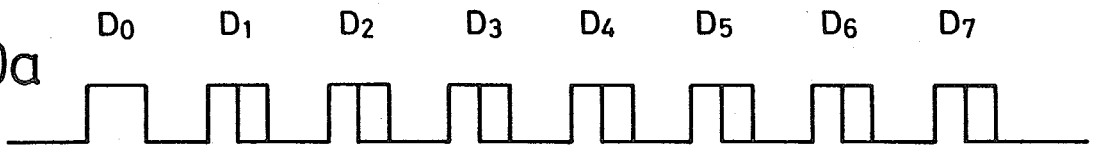
FIGS. 10 to 12 are operational waveform diagrams for various parts in the radio transmitter and the processing equipment.
Figure 10B:
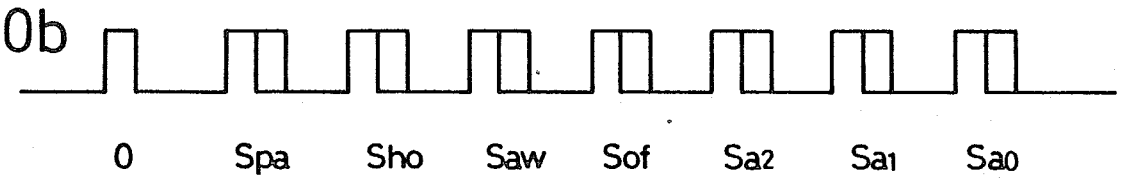

In addition, the radio transmitter for detection includes an 8-bit data selector 39 for transmitting the signal to be sent to the processing apparatus 7 as an 8-bit serial signal. The 8-bit signal that is transmitted from the data selector 39 consists, as shown by FIG. 10*a*, of a first bit ($D_0$) "1" which indicates that it is an information from a radio transmitter for detection, a second bit ($D_1$) "detection information ($S_{ig}$)" which represents the presence or absence of a detection signal, a third bit ($D_2$) "test information ($S_{te}$)" which shows that it is in the test operation mode, a fourth and a fifth bit ($D_3$ and $D_4$) "radio set identification information ($S_{d1}$ and $S_{d0}$)" which identifies the radio set from which the signal is coming, a sixth through eight bits ($D_5$ through $D_7$) "system identification information ($S_{a2}$, $S_{a1}$, and $S_{a0}$)" which identifies the security monitoring system concerned. The radio set identification information is an information for identifying the radio set from among a plurality of radio transmitters shown in FIG. 1, and the system identification is an information for identifying the security monitoring system from among a plurality of security monitoring systems that are installed in a plurality of homes and buildings.

In order to transmit the 8-bit signal, the inputs $D_0$ through $D_7$ of the data selector 39 are connected respectively, as shown by FIG. 2, to the power supply voltage Vdd, the output signal of a NOR circuit 35 which is part of a flip-flop 31 that is set by the detected input signal from the input terminal 25, the output signal from a NOR circuit 43 which is part of a flip-flop for testing 41, one end of each of the switches for setting the radio set identification information 47*a* and 47*b* which set the identification information for the radio set, and one end of each of the switches for setting the system identification information 49*a*, 49*b*, and 49*c* which sets the identification information for system identification. Further, on the other ends of the switches for setting radio set identification information 47*a*, 47*b* and the switches for setting system identification information 49*a*, 49*b*, 49*c*, there is supplied the power supply voltage Vdd.

The data selector 39 on whose data inputs are set various kinds of information, selects in succession one bit out of the 8-bit information supplied to the data inputs $D_0$–$D_7$ by means of the 3-bit data selection signal which is supplied to the data selection inputs A, B, and C from the output stages $Q_2$, $Q_3$, and $Q_4$ of a binary counter 51, and outputs them in series and one bit at a time from the output terminal Dout, as shown in FIG. 10*a*, to supply them to one of the inputs for the OR circuit 53. The binary counter 51 is actuated by a pulse signal which is supplied to the clock input from the pulse generator 63 consisting of a NOR circuit 55, an inverter 57, a resistor 59, and a capacitor 61. One of the inputs to the NOR circuit 55 which constitutes the pulse generator 63 is connected to the output of a NOR circuit 89, and the pulse generator 13 is designed to be actuated only when the output signal of the NOR circuit is "0". Under the normal condition, the inputs to the NOR circuit 89 are supplied with the input signals that are all at a "0 level" so that the output of the NOR circuit 89 is in the "1 level" state, and accordingly, the pulse generator 63 and the binary counter 51 are not actuated and are in the state of rest. In addition, the clear input of the binary counter 51 is connected to the output of the NOR circuit 89, and the binary counter 51 is designed to be cleared by the 1 level output signal of the NOR circuit 89.

The output $Q_1$ of the binary counter 51 is supplied to the input to an inverter 65, and the output of the inverter 65 is supplied to the other input of the OR circuit 53. Further, the output of the OR circuit 53 is supplied to the first input to a 3-input AND circuit 67 whose second and third inputs are connected respectively to the outputs $Q_2$ and $Q_5$ of the binary counter 51. By means of an inverter 65, an OR circuit 53, and an AND circuit 67 thus constructed, there is output, from the output of the AND circuit 67, an 8-bit transmission information that is supplied to the data inputs $D_0$–$D_7$ of the data selector 39, in series repeated for a plurality of times, as shown by FIG. 10*a*, that is, repeated for a plurality of times until the output $Q_8$ of the binary counter 51 becomes "1", as will be described later. The 8-bit transmission signal output from AND circuit 67 drives the transistor 71 via a resistor 69. The transistor 71 drives an oscillation circuit 85 consisting of an antenna 37, a resistor 73, a transistor 75, a variable capacitor 77, a resistor 79, capacitors 81 and 83, to output an 8-bit transmission signal from the antenna 37. One of the inputs to a NOR circuit 45 that is part of a test flip-flop 41 is connected to one end of a testing switch 91, and the power supply voltage Vdd is supplied to the other end of the switch 91. The output of a NOR circuit 43 which is part of the test flip-flop 41 is normally in the state of "0" while the output of the NOR circuit 45 is in "1". However, when the testing switch 91 is operated, the output of the NOR circuit 45 becomes "0" and the output of the NOR circuit 43 becomes "1". As a result, the output signal of "1 level" of the NOR circuit 43 is supplied to the data input $D_2$ of the data selector 39 as well as the input of the NOR circuit 89. Then, the output of the NOR circuit 89 becomes "0", actuating the pulse generator 63 and the binary counter 51, and the 8-bit transmission signal supplied to the data inputs of the data selector 39 begins to be transmitted. In the state when the testing switch 91 is operated and the test flip-flop 41 is set, as in this case, there is set a signal "1" for the data input $D_2$ of the data selector 39. Therefore, a signal of "1" is transmitted as a testing information so that it is designed to be recognized as being in the testing mode. When the pulse generator 63 and the binary counter 51 start their operations, the 8-bit transmission signal supplied to the data selector 39 is transmitted repeatedly for a plurality of times and when the output $Q_8$ of the binary counter 51 becomes "1", its output is supplied to the input of the NOR circuit 43 of the test flip-flop 41 to reset the test flip-flop 41, completeing the transmission operation in the testing mode.

The alarm information transmission apparatus is constituted by the flip-flop 31, the data selector 39, the switches for setting identification information, 47*a*, 47*b*, 49*a*, 49*b*, and 49*c*, the binary counter 51, the inverter 65, the OR circuit 53, the AND circuit 67, the pulse generator 63, the NOR circuit 89, the transistor 71, and the oscillation circuit 85.

Further, the output of the NOR circuit 45 which is part of the test flip-flop 41 is connected to the base of the transistor 71 via a diode 107 and a Zener diode 109 that are connected in series. In the normal state in which the test flip-flop is not set, the diode 107 and the Zener diode 109 that are connected in series do not specially affect the transistor 71 since the Zener diode is in the cut-off state. However, when the test flip-flop 41 is set by means of the testing switch 91 and the output of the NOR circuit 45 becomes "0", a Zener current will flow in the Zener diode 109 because of the impression on the Zener diode 109 of a voltage greater than the Zener voltage. Along with the restriction of the base voltage of the transistor 71 by the Zener voltage of the Zener diode 109, the base current of the transistor 71 decreases because of the branching of the current flow to the side of the Zener diode 109. Because of this, there will be a decrease in the driving voltage for the oscillation circuit 85 which is supplied by the transistor 71, and the level of the output transmitted from the antenna 37 will decrease. The state of the reduced output level is set at the lowest output level of transmission in the least favorable conditions by taking the variations in the power supply voltage Vdd, variations in the temperature surrounding the radio transmitter, scatter in the constituent parts, and the like, into account. Accordingly, in the testing mode, the output level of the radio signals transmitted from the antenna 37 of the radio transmitter for detection 1 is set at the worst conditions by considering the various conditions, so that it is designed that signals of the lowest output level are transmitted from the antenna 37. Therefore, a reliable operation in this state is confirmed by carrying out a transmission test between the radio transmitter for detection 1, 3 and the processing apparatus 7, it may be understood that a complete testing operation has been executed.

A binary counter 93 is actuated by a pulse signal from a pulse generator 95 consisting of inverters 97 and 99, a resistor 101, and a capacitor 103, and outputs a checking signal from its output $Q_{24}$ at an interval of one hour, to carry out a check on the check operation mode. The checking signal which is output at an interval of one hour is supplied to the NOR circuit 89, actuates the pulse generator 63 and the binary counter 51 via the NOR circuit 89 to transmit from the antenna 37 an 8-bit information that is set in the data inputs for the data selector 39, as mentioned earlier. When the transmission of the 8-bit information set in the data selector 39 which was actuated by the pulse generator 63 and the binary counter 51 is completed, and the output $Q_8$ of the binary counter 51 becomes "1", the output signal sets the output of a NOR circuit 105 to "0", to clear the binary counter 93. When the binary counter 93 is cleared, the checking signal from its output $Q_{24}$ becomes "0" and the output of the NOR circuit 89 becomes "1" so that the pulse generator 63 and the binary counter 51 stop their operations. As a result, the output $Q_8$ of the binary counter 51, too, becomes "0" so that the output of the NOR circuit 105 becomes "1", and the binary counter 93 starts again the counting operation of one hour to output a checking signal one hour later. On the side of the processing apparatus 7, the checking signal which is generated by the check operation mode at an interval of one hour is received, and by checking that the signal is transmitted at a fixed interval of one hour, confirms the normal operation of the radio transmitter for detection. It is arranged that when the checking signal fails to be transmitted to the processing apparatus 7 at an interval of one hour, that the processing apparatus 7 detects the failure and generates an alarm by judging that the radio transmitter for detection stopped working for some reason.

One of the inputs to the NOR circuit 105 which clears the binary counter 93 is connected to the output of a comparator 113 that comprises an operational amplifier consisting of a power supply voltage detection circuit 111 which detects the lowering in the voltage Vdd of the power supply formed by the batteries. The inverting input of the comparator 113 is connected to the junction of resistors 115 and 117 that are connected in series between the power supply and the ground, while the noninverting input is connected inbetween a resistor 119 and a Zener diode 121 that are connected in series between the power supply and the ground. The Zener diode 121 is for supplying a reference voltage $V_0$ for the comparator 113. The comparator 113 compares the partial voltage of the power supply voltage which is supplied to the inverting input, with the reference voltage, to output a "0" level signal when the partial voltage of the power supply voltage is greater than the reference voltage, but it outputs a "1" level signal when the power supply voltage Vdd drops to a value below the reference voltage to render the output of the NOR circuit 105 to "0" by the signal. As a result, the binary counter 93 is set to a clearing state by the output signal of "0" level from the NOR circuit 105, and the counting operation for generation of a checking signal at an interval of one hour is prevented from taking place. Because of this, checking signals with an interval of one hour are not output to the processing apparatus 7 from the radio transmitter for detection so that the processing apparatus 7 detects an abnormality in the radio transmitter for detection and carries out generation and display of an alarm.

In addition, the 8-bit signal that is transmitted from the radio transmitter in series is arranged to be output with "1 level" signal appearing in the beginning of each bit, as may be seen from FIG. 10*a* and the signals for various kinds of information are to be output following the "1 level"signals.

Figure 3:
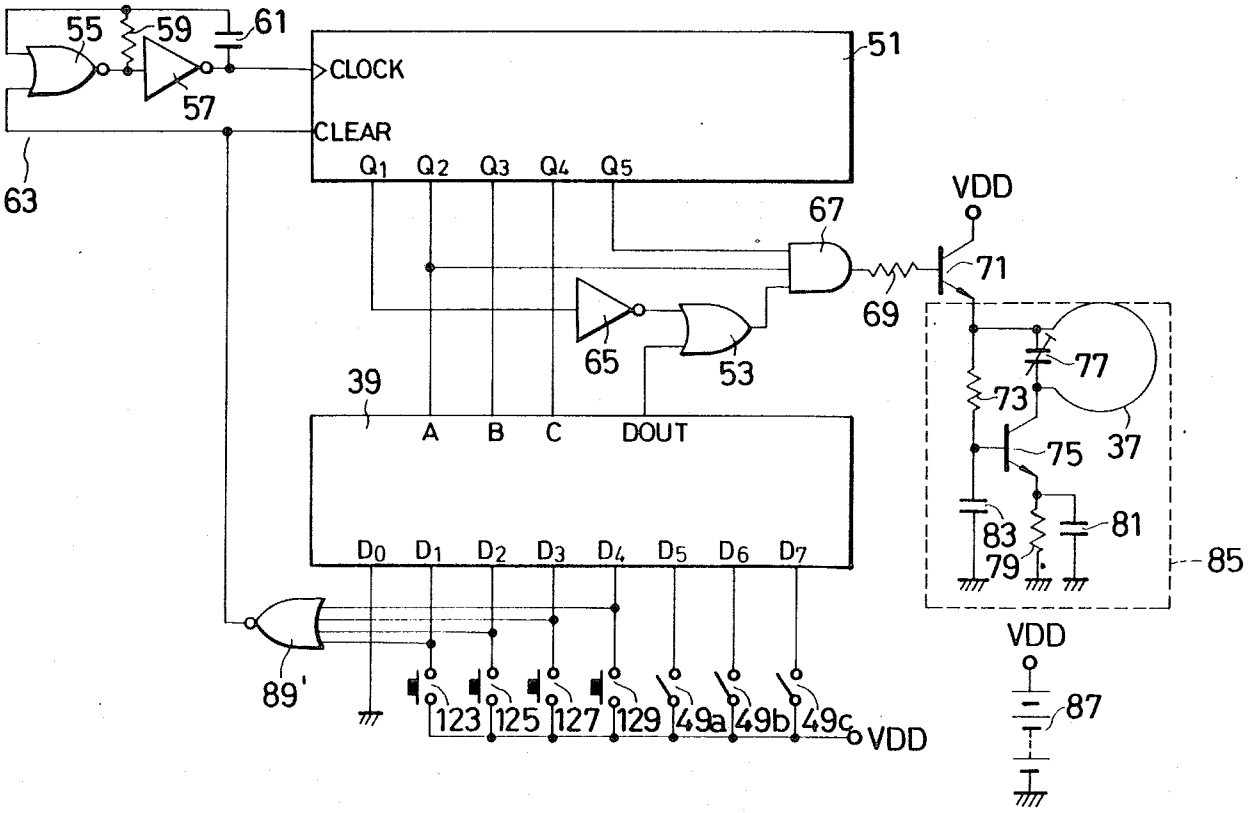

Referring to FIG. 3, there is illustrated a circuit diagram for a radio transmitter for notification 5 which is used by an operator. The radio transmitter for notification 5 shown in FIG. 3 differs from the radio transmitter for detection 1 and 3 shown in FIG. 2 in that the circuit for the former lacks the testing function, the checking operation function to be given at an interval of one hour, the function for detecting the power supply voltage, and the function for processing the detected signal from the detection switch 11 or the smoke detector. In addition, the data input $D_0$ of the data selector 39 is connected to the ground potential to be supplied with a "0 level" signal, and the data inputs $D_1$, $D_2$, $D_3$, and $D_4$ are connected to one end respectively of a panic switch 123 for the panic button 17, a home switch 125 for the home button 19, an away switch 127 for the away button 21, and an off switch 129 for the off button 23. The other end of each switch is connected respectively to the input of a NOR circuit 89', differing from the radio transmitter for detection in that the pulse generator 63 is actuated via the NOR circuit 89' when the circuit finds itself in the on state by the operation of either one of the switches. Moreover, there is provided the power supply voltage Vdd to the other end of each of the switches 123, 125, 127, and 129. Therefore, the same symbols are given to the elements that are identical to those of the radio transmitter for detection shown in FIG. 2.

Moreover, the transmission signal which is output in series from the antenna 37 consists of a first bit "0" which indicates that it is an information from the radio transmitter for notification 5, a second bit through a fifth bit which signify "panic information ($S_{pa}$)", "home information ($S_{ho}$)", "away information ($S_{aw}$)", and "off information ($S_{of}$)", respectively, and a sixth bit through an eight bit "system identification information ($S_{a2}$, $S_{a0}$, and $S_{a0}$)" which identifies the security monitoring system.

Figure 4A:
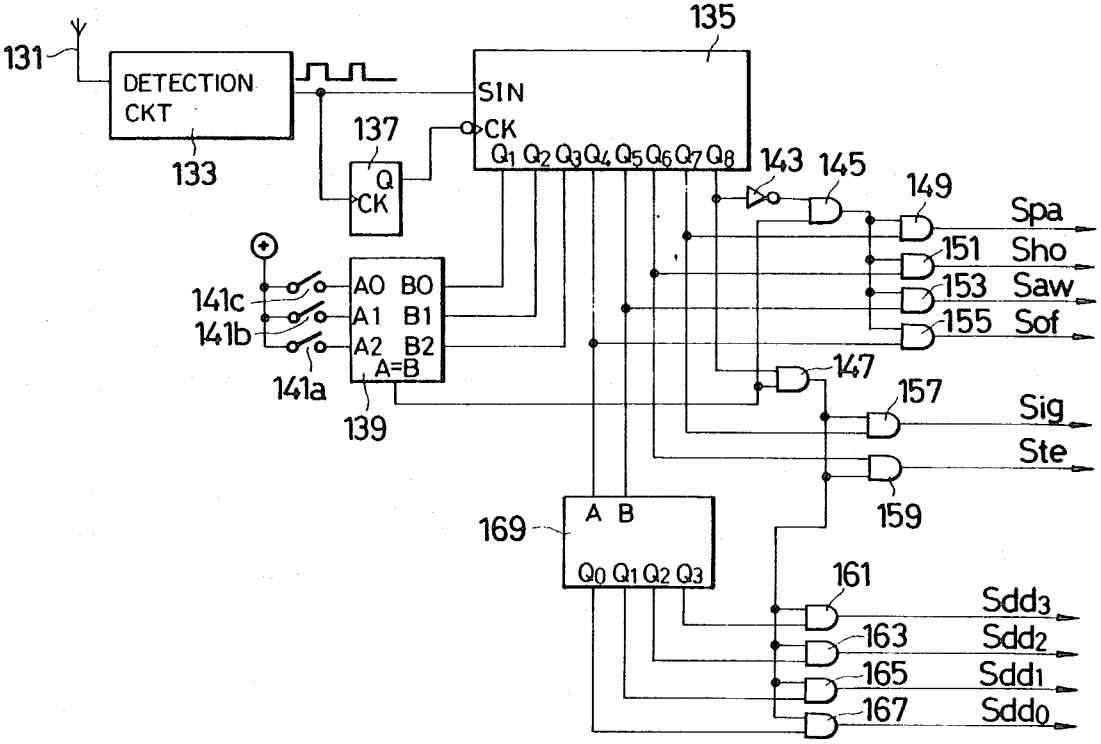
FIGS. 4*a*–4*c* are the circuit diagrams for the processing apparatus used for the security monitoring system shown in FIG. 1.
Figure 4B:
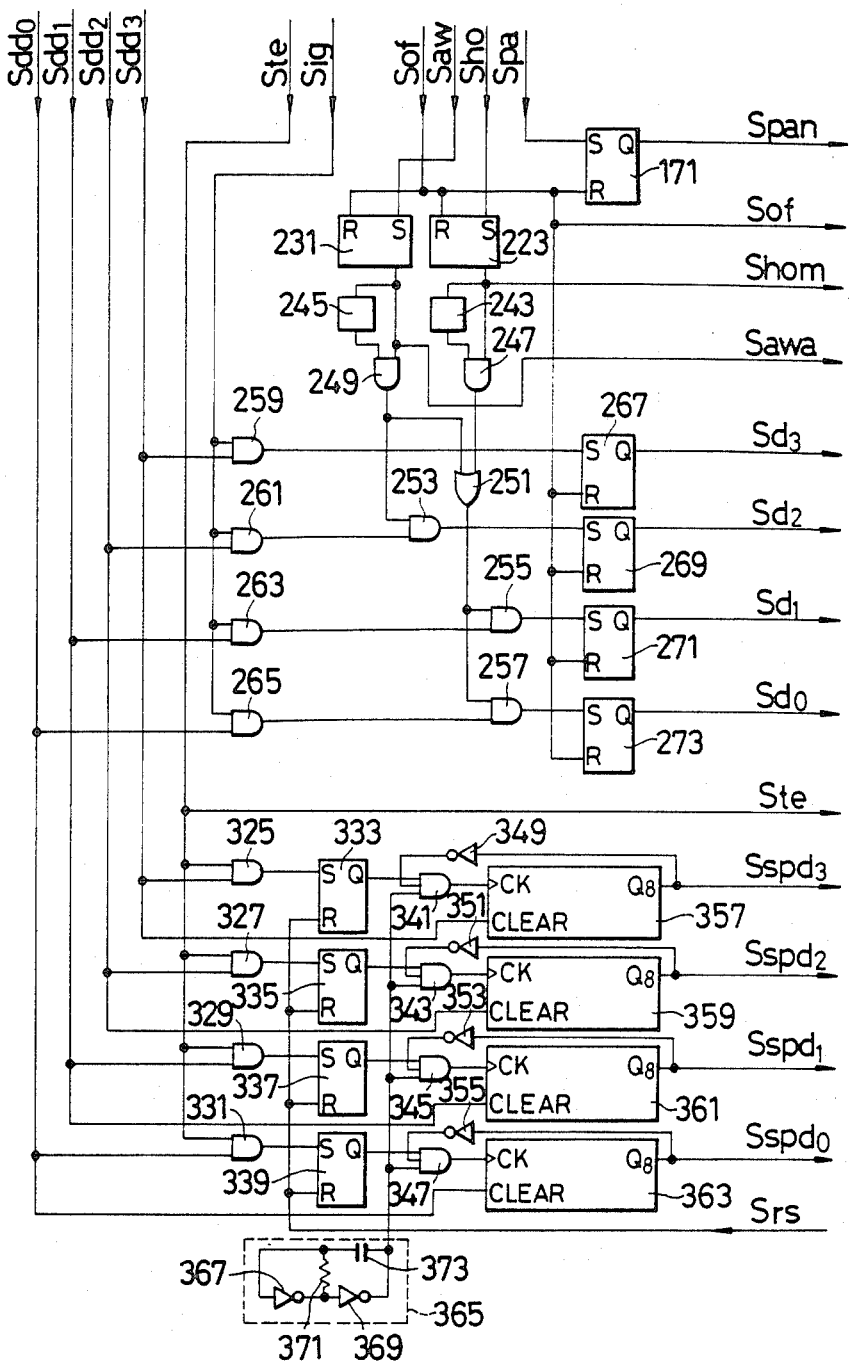
Figure 4C:
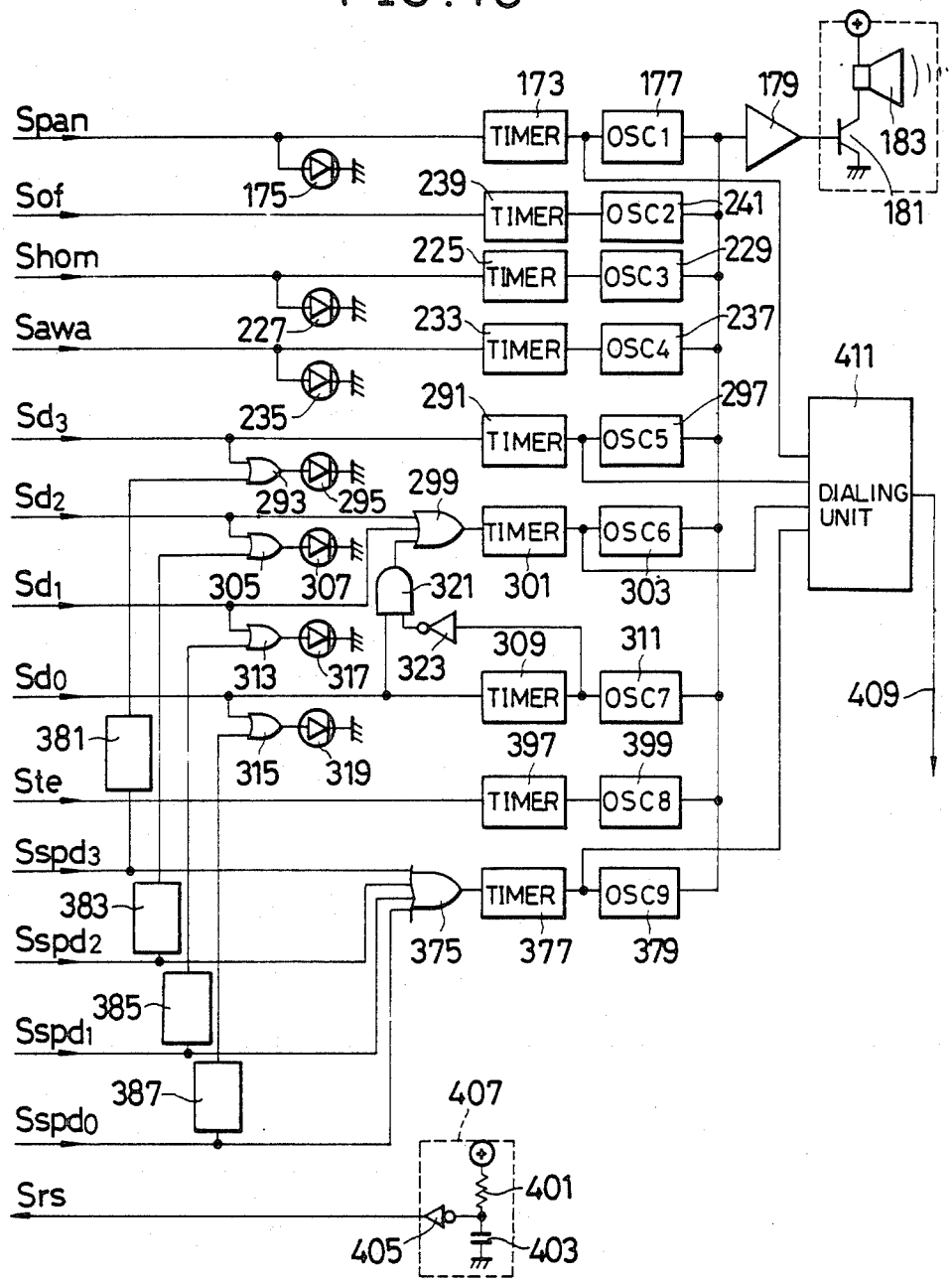
Figure 10C:
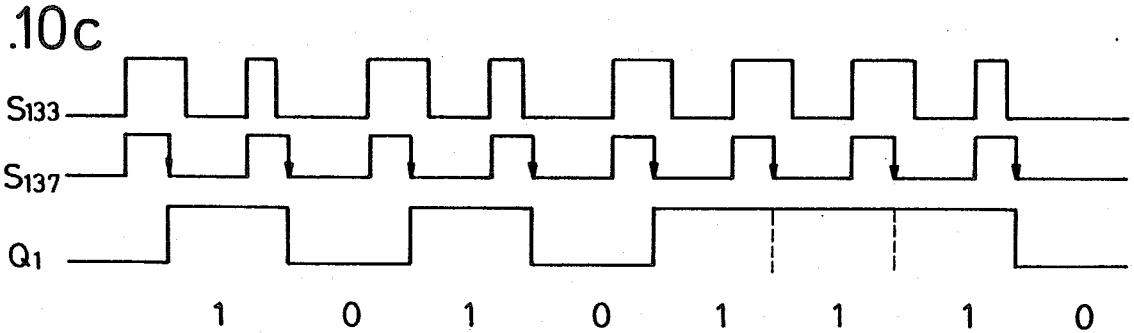

Referring to FIGS. 4*a* to 4*c*, there are illustrated circuit diagrams for the processing equipment 7. First, in FIG. 4*a* the 8-bit transmission information transmitted from the antenna 37 of the radio transmitter for detection 1, 3 and the radio transmitter for notification 5 shown in FIGS. 2 and 3, respectively, is received by the antenna 131 and is detected at a detection circuit 133. The signal which is generated at the output of detection circuit 133 is designated as a signal S133 in FIG. 10*c*. A monostable multivibrator 137, outputs a signal S137, shown in FIG. 10*c*, being triggered by the signal S133. The shift register 135 detects the information in the signal S133 using the signal S137 which is supplied to the clock terminal by the monostable multivibration 137, and stores it one after another as an 8-bit signal. The received data is shown in FIG. 10*c* as the signal that appears in succession at the output $Q_1$ of the shift register 135. The received data shown in FIG. 10*c* is "10101110". The received data stored in the shift register 135 is output from its outputs $Q_{1-Q8}$. In this case, the data which is output at the outputs $Q_{1-Q8}$ of the shift register 135 appears in the order which corresponds to the reverse of the order of the data in which it is set in the data inputs of the data selector 39 for the radio transmitter shown in FIG. 2 or 3. Namely, if the information received by the antenna 131 is an information from the radio transmitter for detection 1 or 3, the output $Q_8$ of the shift register 135 corresponds to "1" which indicates that the information is from the radio transmitter for detection, and similarly, the output $Q_7$ corresponds to the "detected information ($S_{ig}$)", the output $Q_6$ corresponds to the "test information ($S_{te}$)", the outputs $Q_5$ and $Q_4$ correspond to the "radio set identification information ($S_{d1}$ and $S_{d0}$)", and the outputs $Q_3$ through $Q_1$ correspond to the "system identification information ($S_{a2}$, $S_{a1}$, and $S_{a0}$)". Further, if the information received by the antenna 131 is an information from the radio transmitter for notification, the output $Q_8$ of the shift register 135 corresponds to "0" which indicates that it is an information from the radio transmitter for notification 5, and the output $Q_7$ to the "panic information ($S_{pa}$)", the output $Q_6$ to the "home information ($S_{ho}$)", the output $Q_5$ to the "away information ($S_{aw}$)", the output $Q_4$ to the "off information ($S_{of}$)", and the outputs $Q_3$ through $Q_1$ to the "system identification information ($S_{a2}$, $S_{a1}$, and $S_{a0}$)".

Of the received signal stored in the shift register 135, first the "system identification information ($S_{a2}$, $S_{a1}$, and $S_{a0}$)" which is output from the outputs $Q_3$–$Q_1$ is supplied to the inputs $B_2$–$B_0$ on one side of a digital comparator 139. The inputs $A_2$–$A_0$ on the other side of the digital comparator 139 are connected to one end of each of the switches for setting system identification information 141*a*, 141*b*, and 141*c*, supplying the identification information for the security monitoring system. In addition, the power supply voltage Vdd is supplied to the other ends of the switches for setting system identification information 141*a*, 141*b*, and 141*c*. When the two inputs $A_{2-A0}$ and $B_2$–$B_0$ are found equal (A=B), a "1 level" system coincidence signal is output from the output of the digital comparator 139. The system coincidence signal indicates that the information received by the processing apparatus 7 is an information transmitted by a radio transmitter belonging to the system of its own. Therefore, it is arranged that only when system coincidence information is output from the digital comparator 139, the AND circuits 145 and 147 are gated, and further, all of the AND gates 149–167 are gated by the outputs of the AND circuits 145 and 147, to supply the information stored in the shift register 135 to the circuits in the subsequent stages.

Moreover, the output $Q_8$ of the shift register 135 is outputting "1" when the information is from the radio transmitter for detection 1 and 3, and "0" when the information is from the radio transmitter for notification 5. Since the signal obtained by inverting the output $Q_8$ by the inverter 143 is supplied to the AND circuit 145, there are output from the AND circuits 149, 151, 153, and 155 that are gated by the AND circuit 145 a "panic information ($S_{pa}$)" which indicates an emergency situation, a "home information ($S_{ho}$)" which indicates the presence of the occupant or the superintendent of the home or the building, an "away information ($S_{aw}$)" which indicates the absence, and an "off information ($S_{of}$)" for releasing the emergency information or the like, respectively.

Furthermore, the output $Q_8$ of the shift register 135 is directly supplied to the AND circuit 147, and the AND circuits 157 and 159 that are gated by the AND circuit 147 output respectively a detected signal, that is, a "detected signal ($S_{ig}$)" which indicates that it has detected an occurrence of an intruder or a smoke, and a "test information ($S_{te}$)" which indicates that it is in the testing operation mode. Moreover, the output of the AND circuit 147 is supplied to one of the inputs to the AND circuits 161–167 to gate these AND circuits. The other inputs of the AND circuits 161–167 are connected to the outputs $Q_3$–$Q_0$ of a decoder 169. The decoder 169 decodes the outputs of $Q_4$ and $Q_5$ of the shift register 135, namely, the "radio set identification information ($S_{d0}$ and $S_{d1}$)" in this case, that are supplied to the inputs A and B, and outputs as "individual radio set information ($S_{dd3}$, $S_{dd2}$, $S_{dd1}$, and $S_{dd0}$)" from the AND circuits 161, 163, 165, and 167, respectively. The individual radio set information $S_{dd3}$, $S_{dd2}$, $S_{dd1}$, and $S_{dd0}$ are assigned respectively to each of the radio transmitter for detection 1 and 3 and the radio transmitter for notification 5 shown in FIG. 1 in order to be able to discern the radio set from which the information is arriving.

In other words, there are output respectively a detected information $S_{ig}$, a test information $S_{te}$, an individual radio set information $S_{dd3}$, $S_{dd2}$, $S_{dd1}$, and $S_{dd0}$ at the AND circuits 157–167, when the information is received from a radio transmitter for detection 1 or 3, and an panic information $S_{pa}$, a home information $S_{ho}$, an away information $S_{aw}$, and an off information $S_{of}$ are output from the AND circuits 149–157 when the information is received from a radio transmitter for notification 5. Referring to FIGS. 4*b* and 4*c*, it is seen that a panic information $S_{pa}$ from the AND circuit 149 is supplied to the set input of a flip-flop 171. The output of the flip-flop 171 is output as a panic information $S_{pan}$, and it is arranged to drive a timer 173 as well as to display the occurrence of an emergency situation by driving a light-emitting diode 175.

Figure 5A:
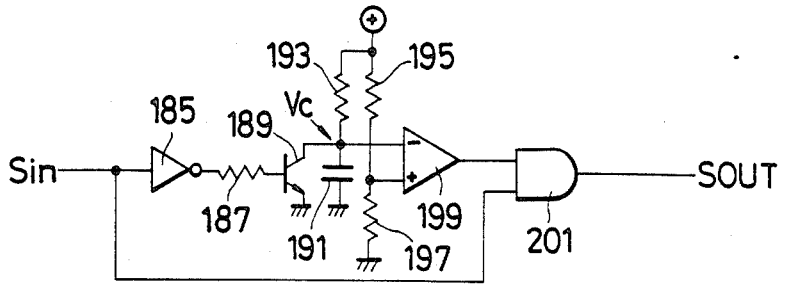
FIGS. 5*a* and 5*b* are a circuit diagram and an operational waveform diagram, respectively, for the timer used in the processing equipment shown in FIG. 4.
Figure 5B:
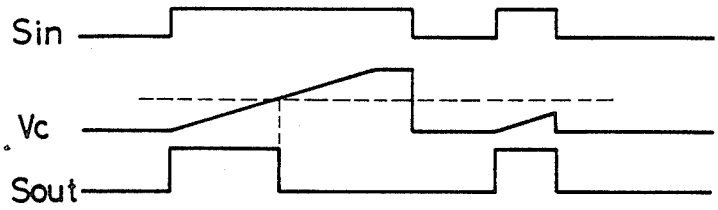

The timer 173 includes a capacitor 191 for forming timing and a resistor 193 which is connected to the capacitor 191 in series, and a transistor 189 is connected to both plates of the capacitor 191, as its detailed circuit diagram and the waveforms for its operation shown in FIGS. 5*b* and 5*c*, respectively, indicate. The transistor 189 is connected to the input via a resistor 187 and an inverter 185, and it is short-circuiting the capacitor 191 under the normal on condition in which the input signal $S_{ig}$ is on the "0" level. The voltage at the junction of the capacitor 191 and the resistor 193, namely, the voltage Vc of the capacitor 191, is supplied to the inverting input of a comparator 199, and is compared with a reference voltage, at the junction of the resistors 195 and 197, which is supplied to the noninverting input of the comparator 199. The resistors 195 and 197 are connected in series between the power supply and the ground. The output of the comparator 199 is connected to one of the inputs to an AND circuit 201, and the input signal is supplied to the other input to the AND circuit 201. When there is no input signal supplied to the timer, there is output no output signal, leaving the timer on the "0" level. When an input signal is supplied to the timer, the transistor 189 is turned off by the input signal which is inverted by the inverter 185, and a charging current begins to flow in the capacitor 191. When the capacitor voltage Vc is below the reference voltage, there is output a "1 level" signal from the comparator 199, and by the action of the output signal and the input signal, an output signal Sout on "1 level" is output from the AND circuit 201. This output signal is kept to be output for a fixed duration until the capacitor voltage Vc achieves the reference voltage. In addition, when the input signal becomes "0", the output signal is interrupted, and the accumulated charge of the capacitor 191 is discharged via the transistor 189.

When the timer 173 is driven by a panic information Span and generates an output signal for a fixed duration, the output signal drives a tone generator 177 to output a tone signal. The tone signal is amplified by an amplifier 179, supplied to an alarm speaker 183 via a transistor 181, and an alarm which announces an emergency situation is generated from the alarm speaker 183.

Figure 6:
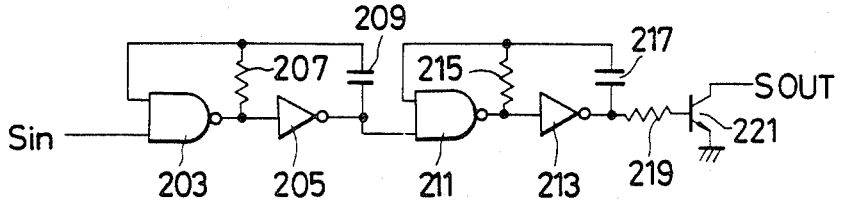
FIG. 6 is a circuit diagram for the tone generator used in the processing equipment shown in FIG. 4.

The tone generator 177 comprises, as a detailed circuit diagram given by FIG. 6 indicates, a first oscillator consisting of NAND circuit 203, an inverter 205, a resistor 207, and a capacitor 209, a second oscillator consisting of a NAND circuit 211, an inverter 213, a resistor 215, and a capacitor 217, and an output transistor 221 to which is connected the output of the latter oscillator via a resistor 219. When the output of the timer is supplied to the tone generator as an input signal, the first oscillator oscillates and the second oscillator oscillates only for durations in which the output from the first oscillator is on "1" level, and a particular alarm sound is arranged to be generated an intermittent outputting of the tone output of the second oscillator by the output of the first oscillator.

The home information $S_{ho}$ from the AND circuit 151 (see FIG. 4*a*) sets a flip-flop 223, and the output of the flip-flop 223 drives a timer 225 as a home information $S_{hom}$ as well as displayed the home information by driving a light-emitting diode 227. The output signal of the timer 225 drives a tone generator 229 to generate an announcing tone which indicates that it is a home information from the speaker 183 via the amplifier 179 and the transistor 181.

The away information $S_{aw}$ from the AND circuit 153 (see FIG. 4*a*) sets a flip-flop 231, and the output signal of the flip-flop 231 drives a timer 233 as an away information $S_{awa}$ as well as drives a light-emitting diode 235 to display the away information. The output signal of the timer 233 drives a tone generator 237, and generates an announcing tone from the speaker 183 via the amplifier 179 and the transistor 181.

The off information $S_{of}$ from the AND circuit 155 (see FIG. 4*a*) resets flip-flops 171, 223, and 231 as well as drives a tone generator 241 via a timer 239 to generate an announcing tone which indicates that it is an off information from the speaker 183 via the amplifier 179 and the transistor 181.

The output signals $S_{hom}$ and $S_{awa}$ from the flip-flops 223 and 231 that are set by the home information $S_{ho}$ and the away information $S_{aw}$, respectively, are output from AND circuits 247 and 249 after being delayed by delay circuits 243 and 245.

Figure 9A:
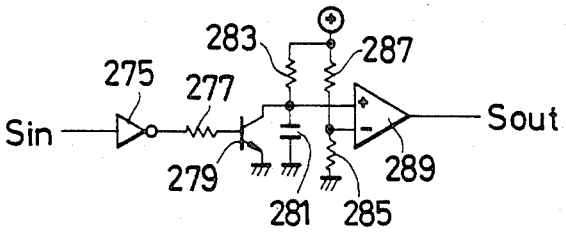
FIGS. 9*a* and 9*b* are a diagram for the delay circuit and its operational waveform diagram, respectively, used in the processing equipment shown in FIG. 4.
Figure 9B:
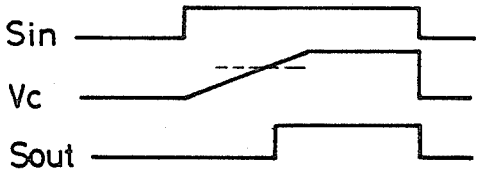

Each of the delay circuits 243 and 245 whose detailed circuit diagram and the waveforms in operation are shown respectively by FIGS. 9*a* and 9*b*, consists of an inverter 275, a resistor 277, a transistor 279, a capacitor 281, resistor 283, 285, and 287, and a comparator 289. When the input signal is "0", the transistor 279 is turned on via the inverter 275 by the inverted signal, and short-circuits the capacitor 281. As the input signal $S_{in}$ becomes "1", the transistor 279 is turned off, a charging current starts to flow in the capacitor 281, and the voltage Vc of the capacitor 281 starts to rise with a time constant that is determined by the capacitor 281 and the resistor 283. When the voltage Vc of the capacitor 281 exceeds the reference voltage determined by the resistor 285 and 287, there is output a delayed output signal Sout from the comparator 289. In addition, when the input signal becomes "0", the transistor 279 is turned on, and the output signal becomes "0".

The detected information $S_{ig}$ from the AND circuit 157 (see FIG. 4*a*) is supplied to one of the inputs in each of the AND circuits 259, 261, 263, and 265, gates the individual radio set information $S_{dd3}$, $S_{dd2}$, $S_{dd1}$, and $S_{dd0}$ from the AND circuits 161, 163, 165, and 167, respectively, that are supplied to the other input of each of the NAND circuits 259, 261, 263, and 265, to output a third, second, first, and zero-th radio set detection signals from the AND circuits 259, 261, 263, and 265, respectively. The output signal of the AND circuit 259 sets a flip-flop 267 for the third radio set detection signal to output a third radio set detection information $S_{d3}$. The output information $S_{d3}$ drives a timer 291 as well as a light-emitting diode 295 via an OR circuit 293 to display the third radio set detection information $S_{d3}$. The output signal of the timer 291 drives a tone generator 297, and generates an alarm which indicates the third radio set detection information from the speaker 183 via the amplifier 179 and the transistor 181.

The output signal of the AND circuit 261, that is, the second radio detection signal, is supplied to one of the inputs to an AND circuit 253, and a delayed away information $S_{awa}$ from the AND circuit 249 is supplied to the other input to the AND circuit 253. Namely, in outputting from the AND circuit 253 a second radio set detection signal by taking a logical product of the second radio set detection signal and the delayed away information $S_{awa}$, the second radio set detection signal is neglected when there does not exist a delayed away information $S_{awa}$, while, when there is a delayed away information $S_{awa}$, it passes through the AND circuit 253 to set a flip-flop 269 to output a second radio set detection information $S_{d2}$ from the flip-flop 269. The output signal $S_{d2}$ drives a timer 301 via an OR circuit 299 as well as a light-emitting diode 307 to display the second radio set detection information $S_{d2}$. The output signal of the timer 301 drives a tone generator 303 and generates an alarm which indicates that it is a second radio set detection information from the speaker 183 via the amplifier 179 and the transistor 181.

The output signals from the AND circuits 263 and 265, that is, the first and the zero-th radio set detection signals, are supplied to one of the inputs to the AND circuits 255 and 257, respectively, and a delayed home information $S_{hom}$ or an away information $S_{awa}$ from the AND circuits 247 and 249 are supplied to the other inputs of the AND circuits 255 and 257 via the OR circuit 251. Namely, in the AND circuits 255 and 257, when the first and the zero-th radio set detection signals are output by taking a logical product of a first and a zero-th radio set detection signals, respectively, and a home information $S_{hom}$ or an away information $S_{awa}$, the first and the zero-th radio set detection signals are neglected when there does not exist a delayed home information $S_{hom}$ or away information $S_{awa}$, they pass through the AND circuits 255 and 257 to set the flip-flops 271 and 273, and they are output from the flip-flops 271 and 273 as a first and a zero-th radio set detection information $S_{d1}$ and $S_{d0}$, respectively. These output signals $S_{d1}$ and $S_{d0}$ drive timers 301 and 309, via the OR circuit 299 and directly, respectively. At the same time, they drive light-emitting diodes 317 and 319 via OR circuits 313 and 315, respectively, to display the first and the zero-th radio set detection information $S_{d1}$ and $S_{d0}$. The output signals of the timers 301 and 309 drive the tone generators 303 and 311, respectively, and generate alarm tones whch identify them as the first and the zero-th radio set detection information from the speaker 183 via the amplifier 179 and the transistor 181. Further, the output signal of the flip-flop 273 is supplied to one of the inputs to an AND circuit 321, while a delayed signal is supplied to the other input via the timer 309. As a result, a signal which is delayed by the timer 309 is output from the AND circuit 321 whose output signal drives the timer 301 via the OR circuit 299.

The test information $S_{te}$ from the AND circuit 159 (see FIG. 4*a*) drives a timer 397, and the output signal of the timer 397 drives a tone generator 399 to generate an announcing tone which indicates that it is in the test operation mode from the speaker 183 via the amplifier 179 and the transistor 181. In addition, the test information $S_{te}$ is supplied to one of the inputs in each of the AND circuits 325, 327, 329, and 331, gates the individual radio set information $S_{dd3}$, $S_{dd2}$, $S_{dd1}$, and $S_{dd0}$ from the AND circuits 161, 163, 165, and 167 that are supplied to the other inputs of the AND circuits 325, 327, 329, and 331, respectively, and sets the flip-flops 333, 335, 337, and 339 by their respective output signals. The output signals of the flip-flops 333, 335, 337, and 339 are supplied to the first inputs of the 3-input AND circuits 341, 343, 345, and 347, respectively, to gate the pulse from a pulse generator 365 which is supplied to their second inputs, to arrange for counting by supplying the above pulse to each of the counters 357, 359, 361, and 363. In addition, the third inputs of the AND circuits 341, 343, 345, and 347 are connected to the output $Q_8$ of respective counters via inverters 349, 351, 353, and 355, respectively. When the output $Q_8$ of the respective counters becomes "1", the counting operation is interrupted by inhibiting each of the AND circuits. Moreover, the clear terminals of the counters 357, 359, 361, and 363 are connected to the individual radio set information $S_{dd3}$, $S_{dd2}$, $S_{dd1}$, and $S_{dd0}$, respectively, to be cleared by the information. Furthermore, the pulse generator 365 is constructed with inverters 367 and 369, a resistor 371, and a capacitor 373.

The counters 357, 359, 361, and 363 count pulses from the pulse generator 365, and after an elapse of four hours, output the third, second, first, and zero-th radio set abnormality information $S_{spd3}$, $S_{spd2}$, $S_{spd1}$, and $S_{spd0}$ from the respective output $Q_8$. However, when the checking signals are transmitted at an interval of one hour from each of the radio transmitter for detection 1 and 3 under the control of the binary counter 93 (see FIG. 2), received by the processing equipment 7, and are input to the clear terminals of the counters 357, 359, 361, and 363, respectively, as individual radio set information $S_{dd3}$, $S_{dd2}$, $S_{dd1}$, and $S_{dd0}$ from the AND circuits 161, 163, 165, and 167, each counter is cleared before the counting time reaches four hours, preventing the third, second, first, and zero-th radio set abnormality information $S_{spd3}$, $S_{spd2}$, $S_{spd1}$, and $S_{spd0}$ from being output from the respective counters.

In other words, when the test operation mode was initiated at the radio transmitters for detection 1 and 3 with transmission of test information from the radio transmitters for detection 1 and 3, the counter among 357–363 that corresponds to the radio transmitter which is executing the test operation mode begins the counting operation. When checking signals at an interval of one hour is normally supplied from the radio transmitter during the counting operation, the counter is cleared by that normal supply of the signals, without outputting a third, second, first, and zero-th radio set abnormality information $S_{spd3}$, $S_{spd2}$, $S_{spd1}$, and $S_{spd0}$ from their respective output $Q_8$. However, when the operation of the binary counter 93 for transmitting checking signals at an interval of one hour due, for example, to the lowering of the battery voltage of the radio transmitter for detection 1 or 3, the corresponding counter in 357–363 will not be cleared since no checking signal will be output from the radio transmitter for detection 1 or 3. Then, a third, second, first, and zero-th radio set abnormality information $S_{spd3}$, $S_{spd2}$, $S_{spd1}$, and $S_{spd0}$ that shows an abnormality in the radio transmitter for detection, namely, the lowering of the battery voltage, will be output from the outputs $Q_8$ of the counters.

Figure 7:
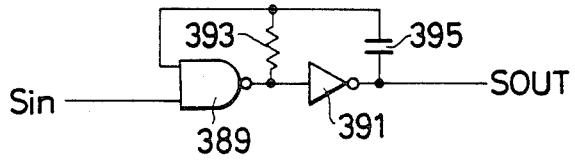
FIG. 7 is a circuit diagram for the oscillator used in the processing apparatus shown in FIG. 4.

The third, second, first, and zero-th radio set abnormality information $S_{spd3}$, $S_{spd2}$, $S_{spd1}$, and $S_{spd0}$ from the counters 357–363 drives a timer 377 via an OR circuit 375, as well as actuate the oscillators 381, 383, 385, and 387, respectively. The output signal of the timer 377 drives a tone generator 379, and generates alarm tones that indicate the third, second, first, and zero-th radio set abnormality information from the speaker 183 via the amplifier 179 and the transistor 181. Further, each of the oscillators 381, 383, 385, and 387 is composed, as illustrated by a detailed circuit diagram shown in FIG. 7, of a NAND circuit 389, an inverter 391, a resistor 393, and a capacitor 395. The oscillation signals of the oscillators 381–387 drive the light-emitting diodes 295, 307, 317, and 319 via the OR circuits 293, 305, 313, and 315, respectively, and the third, second, first, and zero-th radio set abnormality information is displayed by the flashing of each of the light-emitting diodes.

Figure 8A:
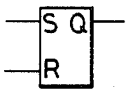
FIGS. 8*a* and 8*b* set forth the circuit notation and the circuit diagram, respectively, for the flip-flop used in the processing apparatus shown in FIG. 4.
Figure 8B:
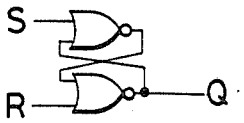

In addition, each of the flip-flops 171, 223, 231, 267–273, 333–339 that are included in FIG. 4*b* is an ordinary flip-flop consisting of a pair of NOR circuits as illustrated in FIG. 8*b*. The flip-flops 267–273 are set respectively by the off information $S_{of}$ from the AND circuit 155. Further, the flip-flops 333–339 are reset at the time of impression of the power supply by the reset signal $S_{rs}$ from the reset circuit 407 for impression of the power supply as shown in FIG. 4*c*. The reset circuit 407 for impression of the power supply is composed of a resistor 401 and a capacitor 403 that are connected in series between the power supply and the ground and an inverter 405, and is arranged to output a reset signal at the time of impression of the power supply for the system. Moreover, the output signals from the timer 173 driven by the panic information $S_{pan}$, the timer 291 driven by the third radio set detection information $S_{d3}$, the timer 301 driven by the second and first radio set detection information $S_{d2}$ and $S_{d1}$, and the timer 377 driven by the third, second, first, and zero-th radio set abnormality information $S_{spd3}$, $S_{spd2}$, $S_{spd1}$, and $S_{spd0}$, drive an automatic dialing unit 411 which is connected to the telephone circuit 409, to transmit these information to the monitoring center by calling it up by the automatic dialing unit 411, and take necessary emergency measures. In addition, the output signal of the timer 309 driven by the zero-th radio set detection information $S_{d0}$ drives another timer 301 via the AND circuit 321 by being delayed by the period of its operation, eventually drives the automatic dialing unit 411. Analogous to the above, the output signal transmits the information carried on it by calling up the monitoring center and takes necessary measures.

The construction of an embodiment of the security monitoring system in accordance with the present invention has been described as in the foregoing. The operation of the system will now be described.

First, the detection operation mode for the case in which an intruder through the door 13 is detected by the radio transmitter for detection 1 or the case in which a smoke is detected by the radio transmitter for detection 3 will be described.

In FIG. 1, when the door 13 is opened by an intruder, the detection switch 11 detects that, and a detected signal is supplied by the detection switch 11 to the input terminal 25 of the radio transmitter for detection 1. Similarly, when a smoke is detected by the smoke detector 15 which is connected to the radio transmitter for detection 3, a detected signal is supplied by the smoke detector 15 to the input terminal 25 of the radio transmitter for detection 3. When a detected signal is supplied to the input terminal 25 of the radio transmitter for detection 1 or 3, the flip-flop 31 in the radio transmitter for detection shown in FIG. 2 is set by a detected signal which passed through a differentiation circuit consisting of the capacitor 27 and the resistor 29, bringing the ouput of the NOR circuit 35 to "1" level. When the flip-flop 31 is set, the NOR circuit 89 becomes "0" by the output of the NOR circuit 35, which actuates the pulse generator 63 and let the binary counter 51 count the output pulses. When the binary counter starts the counting operation, the transmission information which is set in the data inputs of the data selector 39 is supplied, from the output Dout of the data selector 39 to the transmitter 71, successively in series, and is transmitted from the antenna 37 as shown in FIG. 10*a*. The transmission information in this case includes "1", "detected information =1", "test information=0", "radio set identification information", and "system identification information" in which the radio set identification information is the information corresponding to the radio transmitter for detection 1 or 3.

The transmission information output from the radio transmitter for detection in this manner is received by the antenna 131 of the processing equipment 7 shown in FIG. 4 and is detected in the detection section 133. The signal S133 detected in the detection section 133 is stored in succession in the shift register 135 under the control of the monostable multivibrator 137, and is output in parallel from the outputs $Q_1$–$Q_8$ of the shift register 135. Of the outputs $Q_1$–$Q_8$, first the system identification information which is output from outputs $Q_1$–$Q_3$ is compared with the identification information for this system which is set in the inputs $A_0$–$A_2$ in the digital comparator 139. When there is found no coincidence between the two system identification informations, the received information is neglected and no further operation will be carried out. When there is a coincidence, however, a system coincidence signal is output from the output of the digital comparator 139. The coincidence signal gates, together with the output signal on "1 level" which is output from the output $Q_8$ of the shift register 135, the AND circuits 157, 159, 161, 163, 165, and 167 via the AND circuit 147. As a result, a detect information $S_{ig}$ which shows the detection of an intruder or a smoke is output from the AND circuit 157, and either of the individual radio set identification information $S_{dd3}$, $S_{dd2}$, $S_{dd1}$, and $S_{dd0}$ that is decoded by the decoder 169 is output from either of the AND circuits 161–167. The individual radio set identification information $S_{dd3}$, $S_{dd2}$, $S_{dd1}$, and $S_{dd0}$ is for designating which radio transmitter for detection, so that it will be determined by this information whether it is radio transmitter for detection 1 or radio transmitter for detection 3.

The detected signal $S_{ig}$ and the individual radio set identification information $S_{dd3}$, $S_{dd2}$, $S_{dd1}$, and $S_{dd0}$ thus output set either of the flip-flops 267–273 via either of the AND circuits 259–265 shown in FIG. 4*b*, and are output from the flip-flops 267–273 as a third, second, first, and zero-th radio set detection information, $S_{d3}$, $S_{d2}$, $S_{d1}$, and $S_{d0}$ respectively. The radio set detection information $S_{d3}$, $S_{d2}$, $S_{d1}$, and $S_{d0}$ drive, via respectively the OR circuits 293, 305, 313, and 315, either of the light-emitting diodes 295, 307, 317, and 317 to display the third, second, first, and zero-th radio set detection information $S_{d3}$, $S_{d2}$, $S_{d1}$, and $S_{d0}$. Further, the third and zero-th radio set detection information $S_{d3}$ and $S_{d0}$ drive directly the timers 291 and 309, respectively, the second and first radio set detection information signals $S_{d2}$ and $S_{d1}$ drive the timer 301 via the OR circuit 299, drive respectively the tone generators 297, 303, and 311 by the output signals of the respective timers, and generate alarm tones that indicate the third, second, first, and zero-th radio set detection information $S_{d3}$, $S_{d2}$, $S_{d1}$, and $S_{d0}$ from the speaker 183 via the amplifier 179 and the transistor 181. In addition, the outputs of the timers 291 and 301 drive the automatic dialing unit 411, and transmit the third, second, first, and zero-th radio set detection information to the monitoring center by calling up the monitoring center via the telephone circuit 409. After a delay of its timer operation period, namely, after giving an alarm by the speaker 183, the timer 309 drives the timer 301 via the inverter 323, AND circuit 321, and OR circuit 299, and drives the automatic dialing unit 411 from the timer 301, calls up the monitoring center via the telephone circuit 409 to transmit the zero-th radio set detection information $S_{d0}$.

Next, the testing operation mode of the radio transmitter for detection 1 or 3 which is executed by the operation of the testing switch 91 will be described.

In FIG. 2, when the testing switch 91 is operated, the flip-flop for testing 41 is set, the output of the NOR circuit 43 becomes "1". By this, "testing information=1" is supplied to the data input $D_2$ of the data selector 39, and the output of the NOR circuit 89 becomes "0", and the pulse generator 63 and the binary counter 51 are actuated. As a result, analogous to the case in the above, the transmission information which is set in the data inputs of the data selector 39 is output successively in series from the output of the data selector 39, under the control of the binary counter 51, to drive the transistor 71 via the OR circuit 53, AND circuit 67, and resistor 69. Now, in the test mode, the Zener diode 109 and the diode 107 that are connected to the base of the transistor 71 will be put in the active state by the "0" level output of the NOR circuit 45 in the flip-flop for testing 41, reducing the base current of the transistor 71. Therefore, the driving voltage of the oscillation circuit 85 is reduced by the transistor 71, and it is arranged that the antenna 37 outputs the transmission information at the lowest output level under the worst condition in which various conditions are taken into account. It is designed that test will be made to see whether or not the processing apparatus 7 can receive the transmission information which is output with the lowest output level. When the transmission information output from the antenna 37 of the radio transmitter for detection 1 or 3 with the lowest output level is received by the antenna 131 of the processing apparatus 7, the transmission information is stored, analogous to the case of the detection operation mode, in the shift register 135 via the detection section 133 and the monostable multivibrator 137, and gates the AND circuits 157–167 via the AND circuit 147 by the coincidence signal from the digital comparator 139. As a result, there is output a test information $S_{te}$ from the AND circuit 159 and the individual radio set identification information $S_{dd3}$, $S_{dd2}$, $S_{dd1}$, and $S_{dd0}$ from the AND circuit 161–167. The test information $S_{te}$ output from the AND circuit 159 drives directly the timer 397, the output of the timer 397 drives the tone generator 399 and generates an announcing tone which indicates that it is a test information from the speaker 183 via the amplifier 179 and the transistor 181.

Furthermore, the test information $S_{te}$ output from the AND circuit 159 gates the individual radio set identification information $S_{dd3}$, $S_{dd2}$, $S_{dd1}$, and $S_{dd0}$ at the AND circuits 325, 327, 329, and 331, and sets the corresponding flip-flops 333, 335, 357, and 339. When these flip-flops are set, the pulses of the pulse generator 365 which is connected to the AND circuits 341–347 are counted by the counters for monitoring abnormality 357, 359, 361, and 363. These coounters are arranged to be cleared by the individual radio set identification information $S_{dd3}$, $S_{dd2}$, $S_{dd1}$, and $S_{dd0}$ that are output during the testing operation mode described earlier or by the checking signals with an interval of one hour that are output in the check operation mode, as will be described later. If the clearing signals fail to be supplied for over four hours due to lowering in the battery voltage or the like of the radio transmitter for detection, there will be output from the output $Q_8$ of each of the counters the third, second, first, and zero-th radio set abnormality information $S_{spd3}$, $S_{spd2}$, $S_{spd1}$, and $S_{spd0}$. The abnormality information drives the oscillators 381, 383, 385, and 387 as well as the timer 377 via the OR circuit 375. The oscillators 381–387 that are driven by the abnormality information drive the light-emitting diodes 295, 307, 317, and 319 via the OR circuits 293, 305, 313, and 315, and display the corresponding abnormality information by flashing. Moreover, the timer 377 outputs signals for a fixed length of time, and drives the tone generator 379 by the output signal, and generates an alarm tone which indicates the abnormality information from the speaker 183 via the amplifier 179 and the transistor 181. At the same time, the output signal of the timer 377 drives the automatic dialing unit 411, and transmits the radio set abnormality information to the monitoring center via the telephone circuit 409.

Next, the checking operation mode in which the radio transmitter operates automatically at an interval of one hour for transmitting an operation checking signal to the processing apparatus 7 to indicate the normal operation of its own radio transmitter will be described.

Figure 11:
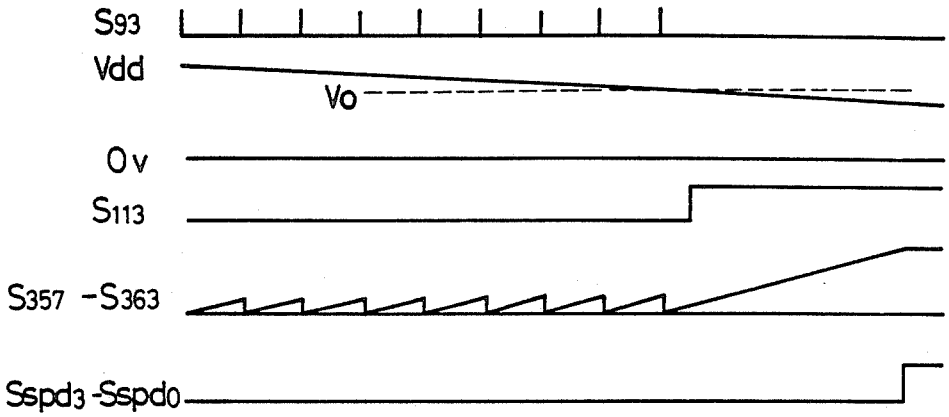

In the radio transmitter for detection 1 or 3 shown in FIG. 2, the check operation mode at an interval of one hour is executed by the binary counter 93. Under the normal condition, the binary counter 93 counts the output pulses from the pulse generator 95, and outputs checking signals S93 at an interval of one hour from its output $Q_{24}$, as shown in FIG. 11. The output signal makes the output of the NOR circuit 89 to be on "0" level which actuates the pulse generator 63 and the binary counter 51. As the pulse generator 63 and the binary counter 51 are actuated the 8-bit transmission information which is set in the data inputs of the data selector 39 is transmitted via the antenna 37 in a manner similar to the case of the detection operation mode or the test operation mode. Here, the output level of the information transmitted from the antenna 37 is the normal one since the flip-flop 41 is not set in the check operation mode and in the detect operation mode, and hence the Zener diode 109 and the diode 107 do not affect the transistor for transmission 71. In the transmission information output from the antenna 37 of the radio transmitter for detection 1 or 3 in the check operation mode include only "1" which indicates that it is a transmission information from the radio transmitter for detection 1 or 3, a radio set identification information, and a system identification information, but neither detected information nor test information.

When a transmission information output in this manner from the radio transmitter for detection 1 or 3 is received by the antenna 131 of the processing apparatus 7, it is stored in the shift register 135 via the detection section 133 and the monostable multivibrator 137. As a result, if the system identification information is identified and coincidence is confirmed in the digital comparator 139, the information stored in the shift register 135 is output under the control of the AND circuit 147. Since neither detected information nor test information is included in the check operation mode there will be output only individual radio set identification information $S_{dd3}$, $S_{dd2}$, $S_{dd1}$, and $S_{dd0}$ that corresponds to the radio transmitter for detection which transmitted the information via the AND circuits 161–167.

The individual radio set identification information $S_{dd3}$, $S_{dd2}$, $S_{dd1}$, and $S_{dd0}$ output from the AND circuits 161–167 is supplied to the clear terminals of the counters for monitoring abnormality 357, 359, 361, and 363, and clears the output S357–S363 of the counters 357–363 as shown in FIG. 11. As a result, the counting result for each of the counters for monitoring abnormality becomes zero hour, so that the radio transmitter abnormality information $S_{spd3}$, $S_{spd2}$, $S_{spd1}$, and $S_{spd0}$ will not be output from the outputs $Q_8$ of the counters. When the clearing inputs are removed, the counters 357–363 start counting, and output a radio set abnormality information from their outputs if the counters are not cleared within four hours by an individual radio set identification information $S_{dd3}$, $S_{dd2}$, $S_{dd1}$, and $S_{dd0}$ from the AND circuits 161–167. However, in the radio transmitter for detection 1 or 3, the check operation mode is generated at an interval of one hour under the control of the binary counter 93, so that the counters 357–363 are arranged to be cleared by that operation.

In a radio transmitter for detection 1 or 3 shown in FIG. 1, the check operation mode is generated at an interval of one hour under the control of the binary counter 93, to transmit checking signals. If the battery voltage Vdd of the radio transmitter for detection drops to below a reference voltage $V_0$ as shown in FIG. 11, the output S113 of the comparator 113 in the power supply voltage detection circuit 111 becomes "1" as shown in FIG. 11. Then, the output of the NOR cicuit 105 becomes "0" by the output S113, and the clear terminal of the binary counter 93 will continue to be supplied with the level "0". Consequently, the binary counter 93 becomes unable to execute the counting operation with a result that there will be no check operation mode which used to be generated at an interval of one hour. Since there will be no checking signal transmitted from the radio transmitter for detection, the counters for monitoring abnormality 357–363 in the processing apparatus 7 will continue counting without being cleared at an interval of one hour. As a result, when the counting time of the counters 357–363 attains four hours, a radio set abnormality information $S_{spd3}$, $S_{spd2}$, $S_{spd1}$, and $S_{spd0}$, will be output from the outputs $Q_8$ as shown in FIG. 11. The radio set abnormality information drives the oscillators 381, 383, 385, or 387 as well as the timer 377 via the OR circuit 375. The oscillators 381–387 driven by the abnormality information drives light-emitting diode 295, 307, 317, or 319 via OR circuit 293, 305, 313, or 315, to flash-display the radio set abnormality information. Further, the timer 377 outputs signal for a fixed length of time, and drives the tone generator 379 by its output to generate an alarm tone which indicates that it is a radio set abnormality information from the speaker 183 via the amplifier 179 and the transistor 181. In addition, the output signal of the timer 377 drives the automatic dialing unit 411 to call up the monitoring center via the telephone circuit 409 to transmit the radio set abnormality information.

Figure 12:
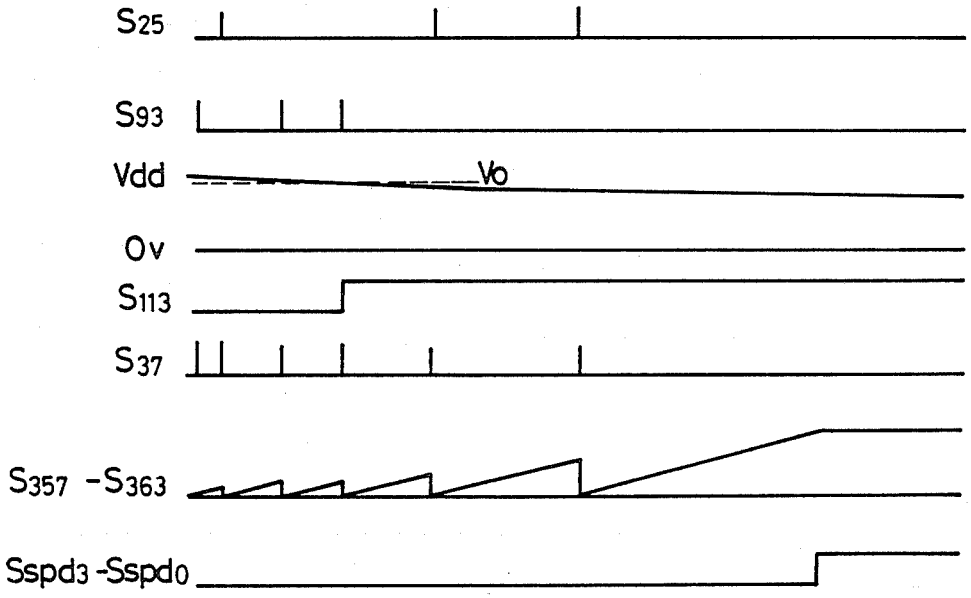

Furthermore, if a detected signal S25 from the detection switch 11 or the smoke detector 15 shown in FIG. 1 comes in as shown by FIG. 12 while the check operation mode at an interval of one hour is in progress, the counters for monitoring abnormality 357–363 are cleared, as shown by FIG. 12, by the individual radio set identification information $S_{dd3}$, $S_{dd2}$, $S_{dd1}$, and $S_{dd0}$ generated by the detected signal. Therefore, even if the counters for monitoring abnormality 357–363 have been continuing the counting operation for over one hour prior to the transmission of the detected signal, due to lowering in the battery voltage Vdd, the counters may sometimes be cleared by the individual radio set identification information $S_{dd3}$, $S_{dd2}$, $S_{dd1}$, and $S_{dd0}$ due to the detected signal.

Next, the operation when the panic button 17, the home button 19, the away button 21, or the off button 23 of the radio transmitter for notification 5 is operated will be described.

When either one of the panic button 17, the home button 19, the away button 21, and the off button 23 of the radio transmitter for notification 5 is operated, the NOR circuit 89' becomes "0" as may be seen from FIG. 3, the pulse generator 63 and binary counter 51 are actuated, and the transmission information set in the data inputs of the data selector 39 is transmitted by the antenna 37 from the output of the data selector 39 via the OR circuit 53, AND circuit 67, resistor 69, and transistor 71. The transmission information in this case is as shown in FIG. **10*b***, and only either one of the information among the panic information $S_{pa}$, the home information $S_{ho}$, the away information $S_{aw}$, and the off information $S_{of}$ that corresponds to the operated button will be transmitted.

When the information transmitted from the radio transmitter for notification 5 is received by the processing apparatus 7, it is stored in the shift register 135 via the detection section 133 and the monostable multivibrator 137. If a system coincidence signal is output by the digital comparator 139 based on the information, there will be output a panic information $S_{pa}$, a home information $S_{ho}$, an away information $S_{aw}$, or an off information $S_{of}$ from the AND circuit 149, 151, 153, or 155 under the control of the AND circuit 145.

The panic information $S_{pa}$ sets the flip-flop 171, and is output from the flip-flop 171 as a panic information $S_{pan}$ to drive the timer 173 as well as the light-emitting diode 175 displaying the occurrence of an emergency situation. The timer 173 drives the tone generator 177 to generate an alarm tone, indicating an emergency situation, for a fixed duration, via the amplifier 179 and the transistor 181. Further, the output of the timer 173 drives the automatic dialing unit 411 to notify the occurrence of an emergency situation to the monitoring center via the telephone circuit 409.

The home information $S_{ho}$ sets the flip-flop 223, and is output from the flip-flop 223 as a home information $S_{hom}$ to drive the timer 225 as well as the light-emitting diode 227 to display the presence information. The timer 225 drives the tone generator 229 to generate an announcing tone indicating the presence information for a fixed duration from the speaker 183 via the amplifier 179 and the transistor 181.

The away information $S_{aw}$, analogous to the case of the home information, sets the flip-flop 231, and is output from the flip-flop 231 as an away information $S_{awa}$ to drive the timer 232 as well as the light-emitting diode 235 to display the away information. The timer 233 drives the tone generator 237 generates an announcing tone indicating the away information for a fixed duration from the speaker 183 via the amplifier 179 and the transistor 181.

In addition, the off information $S_{of}$ drives the flip-flops 171, 223, 231, and 267–273 as well as the timer 239. The timer 239 drives the tone generator 241 to generate an announcing tone indicating the off information for a fixed duration from the speaker 183 via the amplifier 179 and the transistor 181.

In summary, according to the present invention, test is arranged to be carried out by transmitting test signals with the lowest operating level so that it is possible to have a reliable test which takes into account the lowering of the transmission level due to variations in the power supply voltage, changes in the surrounding temperature, scatter in the consituant parts, and so forth, ensuring the operation of the system after the test or after the system installation.

Various modifications will become possible for those skilled in the art after receiving the teachings of the present disclosure without departing from the scope thereof.

What is claimed is:

1. A security monitoring system, comprising:

(a) at least one radio transmitter which includes an alarm information transmission apparatus for transmitting alarm information as a radio signal;

(b) said radio transmitter further including (1) a test signal transmitting means for transmitting test signals at one of a first amplitude level and a second lower amplitude level, and (2) a manually operable setting means for setting a transmission level for transmitting said test signals at said second amplitude level;

(c) a processing apparatus having an alarm unit for receiving the alarm information transmitted from said radio transmitter to carry out alarm processing in accordance with the contents of the alarm information; and (d) said processing apparatus including a first detecting means for detecting whether or not the system operates reliably by receiving the test signals having the second amplitude level.

2. A security monitoring system as claimed in claim 1, in which said radio transmitter further includes an operation checking means for automatically transmitting at a fixed time interval, operation checking signals that indicate normal operation of said radio transmitter, to said processing apparatus, said operation checking signals including said test signal having said first amplitude level.

3. A security monitoring system as claimed in claim 2, in which said processing apparatus includes a second detecting means for detecting whether or not operation checking signals are transmitted from said radio transmitter.

4. A security monitoring system as claimed in claim 1, in which the testing signal transmitting means comprises a test flip-flop for transmitting testing signals by driving the alarm information transmission apparatus.

5. A security monitoring system as claimed in claim 4, in which the alarm information transmission apparatus includes an oscillation circuit for generating oscillating alarm signals, and wherein the setting means sets the transmission level of the testing signals at the second level by decreasing the driving voltage of the oscillator.

6. A security monitoring system as claimed in claim 2, in which the operation checking means comprises a pulse generator for transmitting operation checking signals by driving the alarm information transmission apparatus at fixed intervals of time, and a binary counter which is actuated by the pulse generator for counting said fixed intervals of time.

7. A security monitoring system as claimed in claim 3, including a plurality of transmitters, and said alarm information includes a detection information which represents the presence or absence of a detected signal that indicates the detection of an alarm situation, a test information which indicates that it is in a testing operation mode, and a radio transmitter identification information that uniquely identifies each of said plurality of radio transmitters.

8. A security monitoring system as claimed in claim 3, in which said radio transmitter includes a power supply voltage detection circuit for detecting a predetermined low level of a power supply voltage powering the radio transmitter, and for interrupting the transmission operation of the operation checking means in response thereto.

9. A security monitoring system as claimed in claim 3, in which said first detection means of said processing apparatus comprises timers that are driven based on said test signal from said radio transmitter, tone generators that are driven by the output signals of the timers, and a speaker that generates an announcing tone in accordance with the signal from the tone generator.

10. A security monitoring system as claimed in claim 9, in which the second detection means of said processing apparatus comprises a counter which is cleared by the operation checking signal sent from said radio transmitter and outputs a radio set abnormality information if the counting continues at least for the fixed length of time, oscillators and timers that are driven by the radio set abnormality information from the counter, light-emitting diodes that are driven by signals from the oscillators, and an automatic dialing unit that is driven by output signals from a timers for calling up the monitoring center via a telephone circuit to transmit the radio set abnormality information.

11. A security monitoring system as claimed in claim 7, in which said radio transmitters comprise detection radio transmitters for detecting intrusion, and portable notification radio transmitters carried by operators such as occupants or superintendents of homes or buildings, for informing of the presence or absence of the occupants or the superintendents in the homes or the buildings.

12. A security monitoring system, comprising:

(a) at least one radio transmitter comprising, an alarm information transmission apparatus for transmitting an alarm information by radio signals by sensing an alarm situation, a test signal transmitting means for transmitting a test signal having one of a first amplitude level and a second lower amplitude level, a setting means for setting a transmission level during the transmission of said test signals at the second amplitude level, and an operation checking means for automatically transmitting operation checking signals which indicate normal operation of the transmitter itself, at a fixed interval of time; and (b) a processing apparatus comprising, an alarm unit for receiving said alarm information transmitted from said radio transmitter, and carrying out alarm processing in accordance with the alarm information, a first detection means for receiving the test signals set at the second amplitude level that are sent from the test signal transmitting means to detect whether or not the system operates reliably, and a second detection means for detecting whether or not said operation checking signals are transmitted from said radio transmitter.

13. A security monitoring system comprising:

(a) at least one radio transmitter for transmitting one of a normal transmission level detection information radio signal in response to a sensor signal indicative of an abnormal event, and a low transmission level test detection information radio signal;

(b) a test switch;

(c) means for generating a test signal when said-test switch is closed;

(d) means for lowering the transmission level of said normal transmission level detection information radio signal to a predetermined low transmission level, thereby generating said low transmission level test detection information radio signal in response to the test signal, to test whether said processing apparatus can receive the test detection information signal transmitted at the low transmission level; and (e) a processing apparatus for receiving the test and normal transmitted detection information radio signal, identifying the received detection information signal, and outputting the identified detection information signal for activating an alarm.

14. The security monotoring system as set forth in claim 13, wherein said transmitter further comprises means for automatically transmitting an operation check signal at regular time intervals, to check whether said processing apparatus can receive the operation check signal transmitted at a normal transmission level.

15. The security monitoring system as set forth in claim 13, wherein said test signal generating means comprises a flip-flop for activating said radio transmitter so as to transmit the test detection information radio signal in response to the test signal.

16. The security monitoring system as set forth in claim 15, wherein said radio transmitter comprises a pulse signal generator for generating said test detection information radio signal in response to the test signal, and said transmission level lowering means comprises a Zener diode and a transistor driver, the operation level of the transistor driver for amplifying the test detection information radio signal being lowered to the low transmission level through the Zener diode in response to the test signal outputted from said flip-flop.

17. The security monitoring system as set forth in claim 14, wherein said operation check signal transmitting means comprises a binary counter for counting the number of pulses generated by a pulse signal generator to output the operation check signal.

18. The security monitoring system as set forth in claim 14, wherein said processing apparatus comprises means for detecting whether the operation check signal is transmitted from said radio transmitter.

19. The security monitoring system as set forth in claim 13, wherein said radio transmitter further comprises a supply voltage detection circuit for detecting a drop in a supply voltage to interrupt the test signal.

20. The security monitoring system as set forth in claim 18, wherein said operation check signal detecting means comprises timers activated in response to the test detection information signal transmitted from said radio transmitter, tone generators activated in response to outputs of said timers, and a speaker actuated in response to outputs of said tone generators.

* * * * *